US006534910B1

(12) United States Patent
Vose et al.

(10) Patent No.: US 6,534,910 B1
(45) Date of Patent: Mar. 18, 2003

(54) VHO LAMP WITH REDUCED MERCURY AND IMPROVED BRIGHTNESS

(75) Inventors: Kelly S. Vose, Morgantown, WV (US); Emmanuel Wilhelmus Oomen, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 203 days.

(21) Appl. No.: 09/656,128

(22) Filed: Sep. 6, 2000

(51) Int. Cl.[7] ..... H01J 1/62; H01J 63/04

(52) U.S. Cl. ..... 313/487; 313/631; 313/634

(58) Field of Search ..... 313/485, 487, 313/486, 489, 491, 493, 631, 634, 635, 636

(56) References Cited

U.S. PATENT DOCUMENTS

| | | | | | |
|---|---|---|---|---|---|
| 2,748,306 | A | | 5/1956 | Bjorkman | 313/109 |
| 4,639,637 | A | | 1/1987 | Taubner et al. | 313/489 |
| 5,045,752 | A | * | 9/1991 | Jansma | 313/487 |
| 5,051,653 | A | * | 9/1991 | DeBoer et al. | 313/489 |
| 5,514,932 | A | * | 5/1996 | Willibrordus et al. | 313/489 |
| 5,552,665 | A | | 9/1996 | Trushell | 313/489 |
| 5,602,444 | A | | 2/1997 | Jansma | 313/489 |
| 5,604,396 | A | | 2/1997 | Watanabe et al. | 313/485 |
| 5,612,590 | A | * | 3/1997 | Trushell et al. | 313/487 |
| 5,666,027 | A | | 9/1997 | Jaspers | 313/635 |
| 5,753,999 | A | * | 5/1998 | Roozekrans et al. | 313/489 |
| 5,801,482 | A | | 9/1998 | Verhaar et al. | 313/483 |
| 6,051,922 | A | * | 4/2000 | Schlejen et al. | 313/489 |

FOREIGN PATENT DOCUMENTS

WO WO 9844537 A1 10/1998

WO WO-9844537 A1 * 10/1998

OTHER PUBLICATIONS

Patent Abstracts of Japan, Yamamoto Rikio, "Rapid Starting Fluorescent Lamp," Publication No. 01102845, Apr. 20, 1989, Application No. 62258948, Oct. 14, 1987.

Patent Abstract of Japan: 9213270; Date of Publication 9 (1997). Int'l Cl. H01J 61/35.

Patent Abstract of Japan: 58941 (A); Date of Publication Apr. 9, 1993; Int'l Cl. H01J 61/46.

Patent Abstract of Japan: 09223480 (A); Date of Publication Aug. 26, 1997; Int'l Cl. H01J 61/067.

* cited by examiner

*Primary Examiner*—Vip Patel
*Assistant Examiner*—Kevin Quarterman
(74) *Attorney, Agent, or Firm*—Dicran Halajian

(57) ABSTRACT

An electric lamp has an envelope with an inner surface and two electrodes located at ends of the electric lamp. The electrodes generate ultraviolet radiation in the envelope which is filled with mercury and a charge sustaining gas. The inner surface of the envelope is pre-coated with an aluminum oxide layer to reflect ultraviolet radiation back into the envelope. A tri-phosphate layer is formed over the aluminum oxide to convert the ultraviolet radiation to visible light. The tri-phosphate layer has yttrium oxide, cerium magnesium aluminate, and barium-magnesium aluminate. One of the electrodes is mounted on a short mount along with a mercury capsule, while the other electrode is mounted on a long mount. The long mount has a horizontal portion and a flared portion which is near the lamp end. The horizontal portion is coated with a layer of aluminum oxide to reduce mercury consumption.

12 Claims, 2 Drawing Sheets

| | YCB | YCB | HALO | HALO |
|---|---|---|---|---|
| 0 HR | 17310 | 17170 | 15120 | 15995 |
| 100 HR | 17110 | 17130 | 15100 | 15090 |
| 500 HR | 16970 | 16950 | 12940 | 12990 |
| 1000 HR | 16570 | 16520 | 12180 | 11848 |
| 2500 HR | 15900 | 16040 | 10090 | 9985 |

VHO LAMP WITH REDUCED MERCURY AND IMPROVED BRIGHTNESS

BACKGROUND OF THE INVENTION

1. Field of the Invention

The present invention is directed to very high output (VHO) lamps having a lamp envelope with phosphor coating, and more particularly, to a tri-phosphate coating over an alumina pre-coat and a long mount electrode coated with alumina.

2. Discussion of the Prior Art

Low pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (U.V.) region of the spectrum, with only a small portion in the visible spectrum. The inner surface of the lamp envelope has a luminescent coating, often a blend of phosphors, which emits visible light when impinged by the ultraviolet radiation.

There is an increase in the use of fluorescent lamps because of reduced consumption of electricity. To further reduce electrical consumption, there is a drive to increase efficiency of fluorescent lamps, referred to as luminous efficacy which is a measure of the useful light output in relation to the energy input to the lamp, in lumens per watt (LPW).

To this end, different blends of phosphors are used for the luminescent coating. Further, a metal oxide layer is provided between the luminescent coating and glass envelope. The metal oxide layer reflects the U.V. radiation back into the phosphor luminescent layer through which it has already passed for further conversion of the U.V. radiation to visible light. This improves phosphor utilization and enhances light output. The metal oxide layer also reduces mercury consumption by reducing mercury bound at the tubular portion of the lamp.

To further reduce mercury consumption, the glass seals supporting the electrodes at both ends of the lamp are coated with the metal oxide layer to reduce mercury bound at the end portions of the lamp.

The conventional fluorescent lamps described above typically operate at low power levels, such as 40 watts. Conventional 8 foot VHO lamps with high wall loading can operate on a current of 1.5 Amps, with a lamp power of 215 Watts. Conventional VHO lamps are made with a single layer of phosphor and are manufactured with approximately 15 to 40 mg of mercury. There is a need for a fluorescent lamp with high wall loading, operating efficiently at power levels greater than 100 watts with minimal mercury consumption.

SUMMARY OF THE INVENTION

The object of the present invention is to provide a very high output (VHO) fluorescent lamp with increased luminous efficacy and reduced mercury consumption.

The present invention accomplishes the above and other objects by providing an electric lamp having an envelope with an inner surface and two electrodes located at ends of the electric lamp. The electrodes generate ultraviolet radiation in the envelope which is filled with mercury and a charge sustaining gas.

The inner surface of the envelope is pre-coated with an aluminum oxide layer to reflect ultraviolet radiation back into the envelope. A tri-phosphate layer is formed over the aluminum oxide to convert the ultraviolet radiation to visible light. The tri-phosphate layer consists of yttrium oxide, cerium magnesium aluminate, and barium-magnesium aluminate.

One of the electrodes is mounted on a short mount along with a mercury capsule, while the other electrode is mounted on a long mount. The long mount has a horizontal portion and a flared portion which is near the lamp end. The horizontal portion is coated with a layer of aluminum oxide to reduce mercury consumption.

BRIEF DESCRIPTION OF THE DRAWINGS

Further features and advantages of the invention will become more readily apparent from a consideration of the following detailed description set forth with reference to the accompanying drawings, which specify and show preferred embodiments of the invention, wherein like elements are designated by identical references throughout the drawings; and in which.

DETAILED DESCRIPTION OF THE INVENTION

Figure 1:
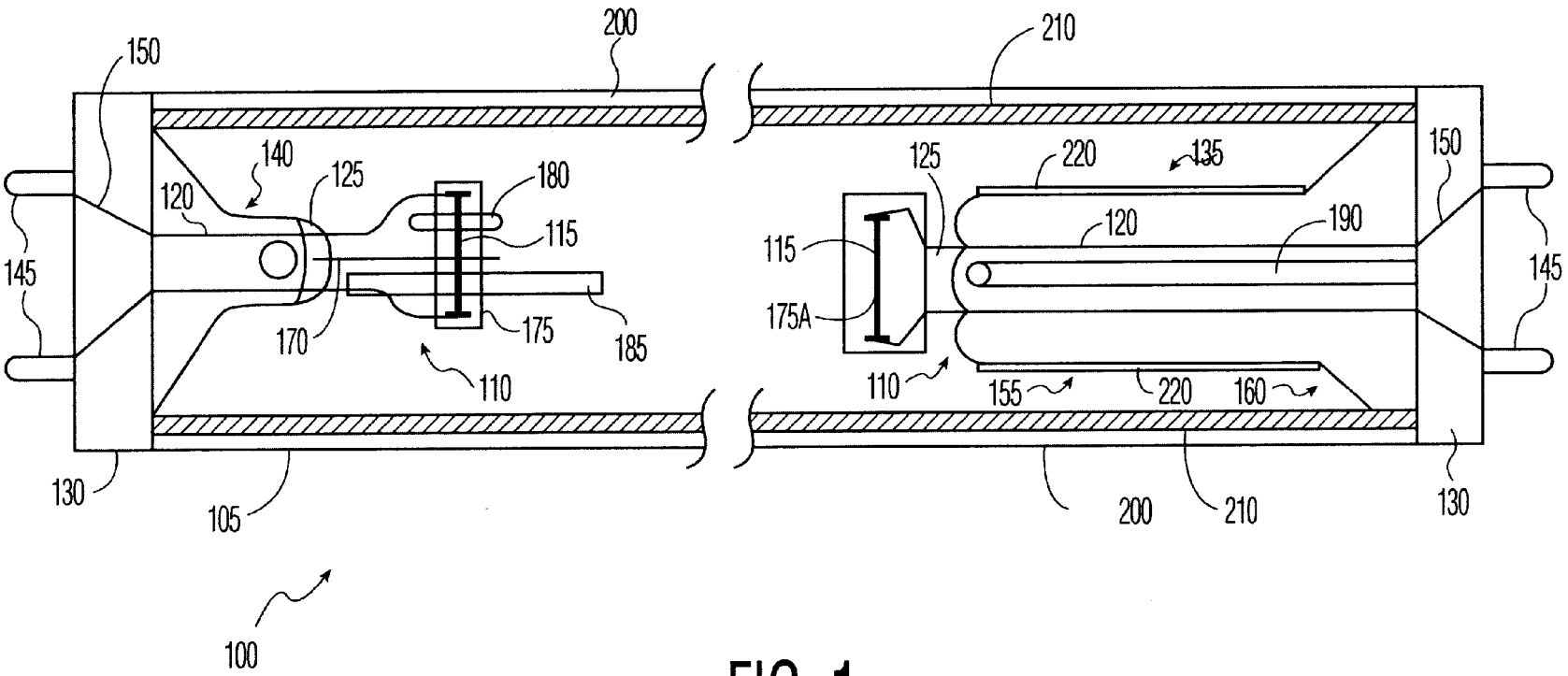
FIG. 1 shows a VHO fluorescent lamp according to present invention.

FIG. 1 shows a very high output (VHO) low-pressure mercury vapor discharge or fluorescent lamp 100 with an elongated outer envelope 105. Preferably the VHO lamp 100 is 8 feet long with high wall loading operating on a current of 1.5 Amps and a lamp power of 215 Watts, for example, which is much larger than a typical fluorescent lamp with a lamp power of 40 Watts.

The VHO lamp 100 has a conventional electrode structure 110 at each end which includes a filament 115 made of tungsten, for example. The filament 115 is supported on conductive lead wires 120 which extend through a glass press seal 125 located at one end of a mount stem near the base 130 of the lamp 100. One of the mount stems of the VHO lamp 100 is longer then the other mount stem, and is referred to as a long mount 135, while the shorter stem is referred to as the short mount 140. Illustratively, the short mount 140 has a length of approximately 40 mm from the base 130 to a cathode ring 175, while the long mount 135 has a length of approximately 80 mm from the base 130 to a cathode guard 175A. The leads 120 are connected to pin-shaped contacts 145 of their respective bases 130 fixed at opposite ends of the lamp 100 though conductive feeds 150.

The mounts stems 135, 140 have a horizontal portion with a flared portion near the end or base 130 of the lamp 100. In FIG. 1, the horizontal portion of the long mount 135 is designated with reference numeral 155 and the flared portion with reference numeral 160.

A center lead wire 170 extends from the short mount 140 to support a cathode ring 175 positioned around the filament 115. The filament 115 of the long mount 135 has a cathode guard 175A which has two rectangular shaped sheets located on opposite sides of the filament 115 of the long mount 135. A glass capsule 180 with which mercury was dosed is clamped on the cathode ring 175 of the short mount 140, and a ribbon 185 provides further support to the cathode ring 175 and the center lead wire 170 of the short mount 140.

As is well known in the art, a metal wire is tensioned over the mercury glass capsule 180 and inductively heated in a high frequency electromagnetic field to cut open the capsule 180 for releasing the mercury into the discharge space inside the envelope 105. Only the short mount 140 contains the mercury capsule 180. The long mount 135 does not contain a mercury capsule, however a cathode guard 175A is provided around the filament 115. The long glass stem mount 135 has an exhaust tube 190 to regulate mercury pressure, thus maximizing the light output for ambient temperatures above 50° F.

The VHO lamp 100 is filled with a discharge-sustaining filling which includes an inert gas such as argon, or a mixture of argon and other gases, at a low pressure. The inert gas in combination with a small quantity of mercury sustain an arc discharge during lamp operation. In the operation of the lamp 100, when the electrodes 110 are electrically connected to a source of predetermined energizing potential via the contact pins 145, a gas discharge is sustained between the electrodes 110 inside the envelope 105. The gas discharge generates ultraviolet (U.V.) radiation which is converted to visible light by a phosphor luminescent layer.

In particular, the inner surface of the outer envelope 105 is pre-coated with a single layer of aluminum oxide $Al_2O_3$ 200 over which a tri-phosphate luminescent layer 210 is formed. The alumina pre-coat 200 reflects the U.V. radiation back into the tri-phosphate luminescent layer 210 through which it has already passed for further conversion of the U.V. radiation to visible light. This improves phosphor utilization and enhances light output. The alumina pre-coat 200 also reduces mercury consumption by reducing mercury bound at the inner surface of the glass lamp envelope 105.

The alumina pre-coat 200 is applied by liquid suspension according to commonly employed techniques for applying phosphor layers on the inner surface of the lamp envelope 105. For example, aluminum oxide is suspended in a water base solution and flushed down the lamp tube or envelope 105 to flow over the envelope inner surface until it exits from the other end. The solution is dried in a drying chamber and then the tri-phosphate coat 210 is applied in a similar fashion and sintered or baked for a period of time.

The tri-phosphate coat 210 consists of red-luminescing yttrium oxide activated by trivalent europium (YOX), green-luminescing cerium magnesium aluminate in which terbium acts as an activator (CAT), and blue-luminescing barium-magnesium aluminate activated by bivalent europium (BAM). This allows the VHO lamp 100 to have reduced mercury consumption due to the alumina pre-coat 200 which shields the glass envelope 105 from mercury. In addition to the alumina pre-coat 200, the tri-phosphate layer 210 provides lower mercury consumption than other phosphates, such as halophosphates, as well as increased brightness.

The increased brightness and reduced mercury consumption is achieved by replacing the heavy phosphor layer, e.g., the halophosphate layer, of a conventional VHO lamp with the low weight tri-phosphate layer over the U.V. alumina pre-coat layer. Typically for an 8 foot VHO lamp, the weight of the halophosphates layer used in making conventional VHO lamps is approximately 10–14 g. By contrast, the weight of the tri-component phosphor layer 210 is considerably lower, such as approximately 5–7 g. The weight of the alumina pre-coat layer 200 is approximately 220–520 mg.

Figure 2:
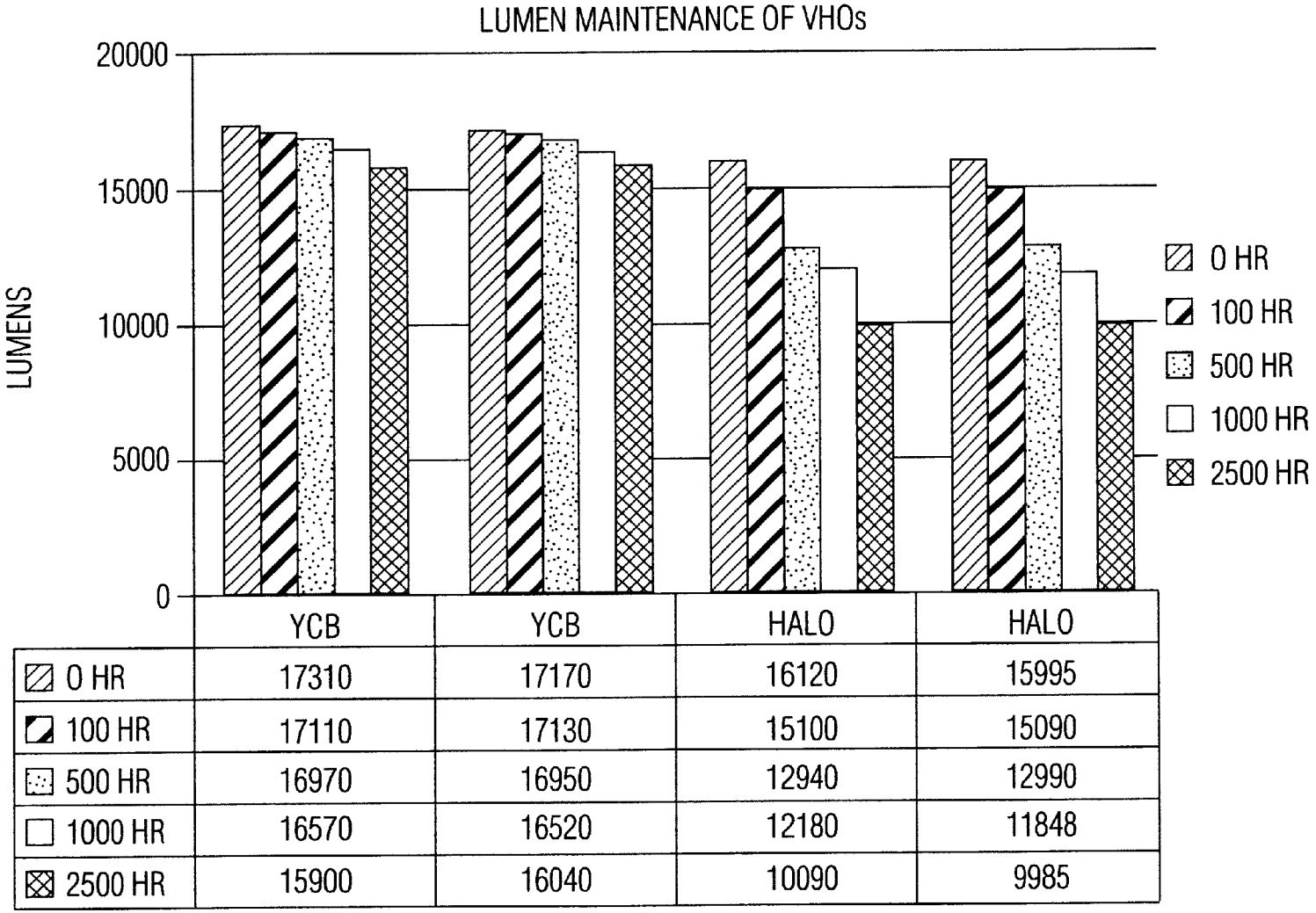
FIG. 2 shows a bar graph comparing the lumens of the VHO fluorescent lamp according to present invention with a conventional VHO lamp.

As shown in FIG. 2, the VHO lamp 100 with the tri-phosphate layer YCB 210 has increased brightness with a lumen output of over 17,000 lumens after 100 hours of burning. Further, the VHO lamp 100 has approximately 15,000 lumens after 2500 hours of operation as compared to approximately 10,000 lumens for conventional VHO lamps with halophosphates (HALO) instead of the tri-phosphate YCB layer. The increased light output and lumen maintenance shown from FIG. 2 is due to the superior tri-component phosphor 210, as well as the U.V. pre-coat layer 200 which reduces the interaction of mercury ions with the glass envelope 105 and reflects the U.V. rays more efficiently back into the tri-phosphor layer 210 to improve utilization of the phosphor and enhance visible light production.

The low mercury requirement of the VHO lamp 100 is attributed to the use of the mercury capsule 180 with the presence of the reflective alumina pre-coat layer 200, which not only renders less interaction between the mercury ions and the glass envelope 105, but also enhances lumen output of the tri-phosphor layer 210.

Conventional VHO lamps are manufactured with approximately 15–40 mg of mercury. To further reduce mercury consumption in the electrode region, the long glass stem 135 is coated with an alumina layer 220, such a layer of aluminum oxide. In particular, the horizontal portion 155 of the long glass stem 135 is coated with an alumina layer 220 while the flare portion 160 and the press seal portion 125 are not coated. Coating the flare portion 160 with the alumina layer interferes with the seal between the glass of the envelope 105 as well as the glass of the flare portion 160 and the base 130.

A thin coat of aluminum oxide 220 is painted unto the horizontal portion 155 of the long glass mount 135, which is then baked at 100° C. for approximately 1 hour. Mercury consumption of a coated long mount versus a non-coated long mount is then compared over 500 and 1000 hours.

Wet chemical analysis (WCA) is used to determine the quantity of free and bound mercury in the lamp. This is done by collecting the free mercury in a cold spot at the center of the lamp. The lamp is then cut up into segments and transferred to vessels containing nitric acid $HNO_3$. The mercury is dissolved in the acid at 60° C. for approximately 3 hours. After the acid treatment, a small amount of 0.01 M $KMNO_4$ solution is added to the samples to stabilize the mercury ions $Hg^{2+}$. Cold vapor atomic absorption spectroscopy is used for detection of mercury.

The short mount 140 which contains the mercury capsule 180 is not coated with the alumina layer. Only the horizontal portion 155 of the long mount 135 is coated with the alumina layer 220. Lamps were made with the alumina pre-coat layer 200 under a heavy halophosphate phosphor layer. Half of these halophosphate VHO lamps contained long step mounts coated with the alumina layer 220. Similarly, another group of lamps was made with the long step mounts coated with the alumina layer 220, but have the pre-coat alumina layer 200 under the tri-phosphate layer 210, instead of under a halophosphate layer. Again, half of these tri-phosphate VHO lamps contained long step mounts coated with the alumina layer 220.

In all cases, the alumina layer 220 did not have adverse effects on the lamp operation and brightness. Rather, the alumina layer 220 reduced mercury consumption in the electrode region of the long mount 135. Table 1 shows mercury consumption data in the electrode region of the long mount 135 for VHO lamps having a tri-phosphor layer according to the present invention and VHO lamps having a halophosphate layer, with and without the alumina layer 220 on the horizontal portion 155 of the long mount 135.

As shown in Table 1, at the first 500 hours, there are minimal differences between the coated and uncoated long stems. At 1000 hours of operation, differences of up to 40% are observed between the coated and uncoated long stems.

The same or larger differences are expected at 2500 hours of operation. The lower mercury consumption observed for the coated long mounts is attributed to the presence of the alumina coat 220 that renders less interaction between the mercury ions and the glass of the long stem mount 135.

TABLE 1

| | 500 hr Coated Stems | 500 hr un-coated Stems | 1000 hr Coated Stems | 1000 hr un-coated Stems |
|---|---|---|---|---|
| Halophaspate Lamps | | | | |
| Lamp 1 | .131 | .176 | .141 | .303 |
| Lamp 3 | .111 | .148 | .197 | .284 |
| Lamp 3 | .110 | .225 | .197 | .480 |
| Lamp 4 | .152 | .322 | .169 | .264 |
| Average | .126 | .218 | .176 | .333 |
| Tri-Phosphor Lamps | | | | |
| Lamp 1 | .052 | .185 | .068 | .098 |
| Lamp 2 | .059 | .056 | .090 | .106 |
| Lamp 3 | .081 | .061 | .075 | .194 |
| Lamp 4 | .033 | .122 | .055 | .110 |
| Average | .056 | .106 | .072 | .127 |

In order to obtain the maximum light output for the VHO lamp, a cold spot is created behind the electrode by using the long mount 135. Therefore, in order to minimize the mercury consumption in the electrode region, the horizontal portion 155 of the long mount is coated with the alumina layer 220. Coating the short mount 130 with alumina is not advantageous for VHO lamps and provides minimal effect, since mercury is attracted by the larger glass surface area of the long mount 135. The flare portion 160 is not coated with the alumina layer 220 in order not to interfere with the seal of the base 130 with the envelope 105.

While the present invention has been described in particular detail, it should also be appreciated that numerous modifications are possible within the intended spirit and scope of the invention. In interpreting the appended claims it should be understood that:

a) the word "comprising" does not exclude the presence of other elements than those listed in a claim;

b) the word "consisting" excludes the presence of other elements than those listed in a claim;

c) the word "a" or "an" preceding an element does not exclude the presence of a plurality of such elements.

d) any reference signs in the claims do not limit their scope; and e) several "means" may be represented by the same item of hardware or software implemented structure or function.

What is claimed is:

1. An electric lamp comprising:

an envelope having an inner surface;

means for generating ultraviolet radiation within the envelope;

an aluminum oxide layer formed over said inner surface; and a tri-phosphate layer formed over said aluminum oxide to convert said ultraviolet radiation to visible light;

wherein said tri-phospate layer consists of yttrium oxide, cerium magnesium aluminate, and barium-magnesium aluminate, wherein said means includes a first mount for supporting a first electrode and a second mount for supporting a second electrode, and wherein said first mount is shorter than said second mount.

2. The electric lamp of claim 1, wherein said second mount having a horizontal portion with a flared portion which is near an end of said electric lamp, wherein said horizontal portion is coated with said aluminum oxide layer.

3. The electric lamp of claim 2, further comprising a mercury capsule supported on said short mount.

4. The electric lamp of claim 1, wherein a power consumption of said electric lamp is greater than 200 watts and a length of said electric lamp is greater than four feet.

5. The electric lamp of claim 1, wherein a weight of said tri-phosphate layer is approximately five to seven grams.

6. The electric lamp of claim 1, wherein a weight of said aluminum oxide layer is approximately 220 to 520 milligrams.

7. An electric lamp comprising:

an envelope having an inner surface;

a first aluminum oxide layer formed over said inner surface;

a first mount for supporting a first electrode located at a first end of said electric lamp;

a second mount for supporting a second electrode located at a second end of said electric lamp, wherein said first end is opposite said second end, said second mount having a horizontal portion with a flared portion which is near said second end, wherein said horizontal portion is coated with a second aluminum oxide layer and wherein said first mount is shorter than said second mount; and a tri-phosphate layer formed over said first aluminum oxide.

8. The electric lamp of claim 7, wherein said tri-phosphate layer consists of yttrium oxide, cerium magnesium aluminate, and barium-magnesium aluminate.

9. The electric lamp of claim 7, further comprising a mercury capsule supported on said short mount.

10. The electric lamp of claim 7, wherein a power consumption of said electric lamp is greater than 200 watts and a length of said electric lamp is greater than four feet.

11. The electric lamp of claim 7, wherein a weight of said tri-phosphate layer is approximately five to seven grams.

12. The electric lamp of claim 7, wherein a weight of said first aluminum oxide layer is approximately 220 to 520 milligrams.

* * * * *